US005899769A

United States Patent [19]

Konetschny et al.

[11] Patent Number: 5,899,769

[45] Date of Patent: May 4, 1999

[54] DEVICE FOR CONNECTING A COAXIAL CABLE TO CONTACTS WHICH CAN BE CONNECTED TO EXTENSION LEAD ARRANGEMENTS

[75] Inventors: Volker Konetschny, Putzbrunn; Gunter Petram, Munich, both of Germany

[73] Assignee: Pruftechnik Dieter Busch A.G., Ismaning, Germany

[21] Appl. No.: 08/556,928

[22] PCT Filed: Mar. 31, 1994

[86] PCT No.: PCT/EP94/01023

§ 371 Date: Nov. 29, 1995

§ 102(e) Date: Nov. 29, 1995

[87] PCT Pub. No.: WO95/27319

PCT Pub. Date: Oct. 12, 1995

[51] Int. Cl.[6] ..... H01R 17/04

[52] U.S. Cl. ..... 439/394; 439/427; 439/578

[58] Field of Search ..... 439/426, 427, 439/578–585, 394

[56] References Cited

U.S. PATENT DOCUMENTS

| | | | |
|---|---|---|---|
| 3,744,007 | 7/1973 | Horak | 439/394 |
| 3,977,752 | 8/1976 | Freitag | 439/394 |
| 5,052,946 | 10/1991 | Homolka | 439/427 |
| 5,068,248 | 11/1991 | Gaver, Jr. et al. | 439/394 |
| 5,318,458 | 6/1994 | Thorner | 439/427 |

*Primary Examiner*—J. J. Swann

*Attorney, Agent, or Firm*—Kirkpatrick & Lockhart LLP

[57] ABSTRACT

A device for connecting a coaxial cable to first and second contacts which are secured in an enclosure. The enclosure is equipped with an insert having an inner bore to snugly seat the coaxial cable and whose center axis is in true alignment with the first contact. The second contact includes a contact spring device circumferentially clamped in the enclosure in an essentially rigid manner and having tabs with sharp free ends extending toward a contact pin rigidly fastened in the enclosure. The tabs are bent outward at identical angles from a plane defined by the clamped position of the contact spring device toward the inner bore of the insert. The insert is equipped with a rigid thrust face for exertion of pressure against the tabs of the contact spring device. The contact spring device, the contact pin and the insert are matched to one another and located in the enclosure. The contact pin axially penetrates the inner conductors of the coaxial cable and the tabs of the contact spring device cut an outer cable insulation and press into contact with a cable shield in the coaxial cable when the coaxial cable has been cleanly cut perpendicular to its longitudinal axis and is located in the inner bore of the insert, is pushed some distance onto the contact pin and the insert is then pushed by a clamping nut over a defined distance toward the contact pin.

12 Claims, 2 Drawing Sheets

DEVICE FOR CONNECTING A COAXIAL CABLE TO CONTACTS WHICH CAN BE CONNECTED TO EXTENSION LEAD ARRANGEMENTS

The invention relates to a device as claimed in the pre-characterizing portion of claim 1.

Devices of this type make it possible to connect a coaxial cable to an electronic device which itself is connected to the two contacts in the enclosure by means of any type of lead arrangements, such as a component conductor or even coaxial cable.

With a prior art device of this type (U.S. Pat. No. 4,761,146), the first contact is in the form of a thin-walled sleeve having an inside diameter corresponding to the diameter of the inner conductor of the coaxial cable. The second contact is in the form of a thin-walled, hollow cylinder coaxial to the first contact and having an inside diameter corresponding to the diameter of the insulation between the inner conductor and the cable shield of the coaxial cable. That end of the hollow cylinder facing the coaxial cable forms a point and protrudes beyond the first, inner contact toward the coaxial cable.

To connect the coaxial cable to the contacts in the enclosure of the prior art device, a section of the cable shield on one end of the cable is first exposed by making a cut in the outer insulating sleeve of the cable and peeling it back over the section. The exposed section of the shield is then folded back over the coaxial cable and a hollow cylinder having the same shape as the second contact is attached to a special tool and inserted between the cable shield and the insulation surrounding the inner conductor of the coaxial cable while simultaneously twisting the cable back and forth to separate a length of the cable shield from this insulation and make space for the second contact. Inside the device enclosure, the coaxial cable with the exposed inner insulation is threaded and fed into the second contact. The first contact slides along the inner conductor between the conductor and the insulation, seating one end section of the conductor to form a contact, while the second contact, just as the hollow cylinder of the tool previously, makes contact with the cable shield and slides between the same and the insulation surrounding the inner conductor. The insert previously placed over the cable is then pushed along the coaxial cable into the cavity surrounding the device and clamped in the enclosure by means of the clamping nut, which had likewise been previously placed on the cable. During this clamping process, a shoulder in the inner bore of the insert is pressed against the layers of the coaxial cable surrounding the second contact, i.e. the shield and the outer insulation, clamping these layers against the second contact, thus fixing the cable with respect to the enclosure.

With the device of the prior art, a significant amount of work is required to connect the coaxial cable, which can only be reliably effected by means of a special tool.

The object of the current invention is to create a device as claimed in the pre-characterizing portion of the principal claim which makes it possible with a substantially lesser amount of work to reliably connect a coaxial cable which has been cut cleanly across the perpendicular to the longitudinal axis, without special tools and without any other manipulation of the cable as such other than simple cutting off the end.

The above-mentioned object is achieved by means of the characterizing features disclosed in claim 1.

With the device as claimed by the current invention, the coaxial cable, which has cut by means of a wire cutter or similar device so as to have a clean, even cut surface, is inserted into the inner bore of the insert, which has been inserted into the enclosure and is held in place by means of a clamping nut, until the tip of the pin penetrates a short way into the preferably multi-strand inner conductor. After insertion of the cable, the clamping nut is tightened, drawing the insert and also the coaxial cable closer to the contact pin. By so doing, the thrust faces of the insert bend the contact studs of the second contact toward its circumferential clamping plane. The effect of this bending is that the tab ends approach one another in the direction of the contact pin, cutting the outer layer of insulation of the coaxial cable, and are pressed against the cable shield to form a reliable contact with the same. At the same time, the contact pin is inserted more deeply into the inner conductor. Appropriate stops limit the bending of the contact studs of the second contact to that amount required for the tabs to establish a firm contact with, but not cut, the cable shield. The clamping nut need only be screwed down to the enclosure to effect the cable connection.

The sub-claims refer to preferred embodiments of the device as claimed in claim 1.

One embodiment of the invention is described in greater detail below with reference to the attached drawings.

Figure 1:
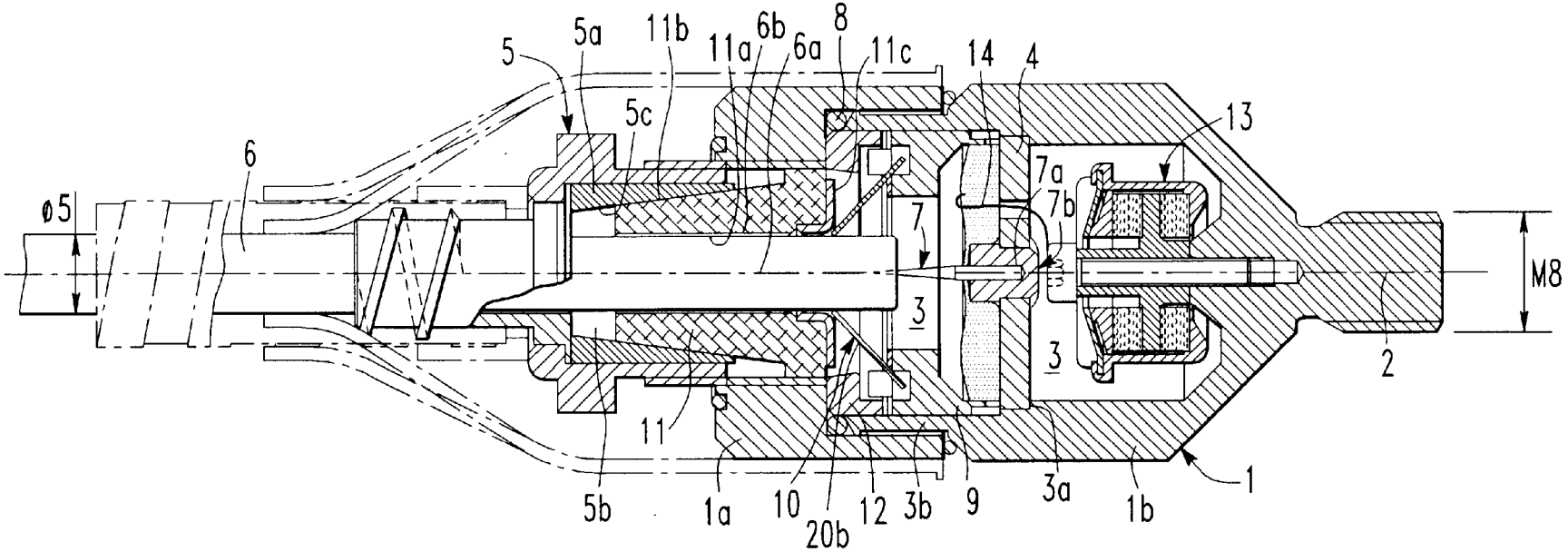
FIG. 1 shows a longitudinal section through the center of a preferred embodiment of the device immediately prior to the clamping of the insert, into which the coaxial cable to be connected has already been inserted until reaching the tip of the contact pin.

The device as shown in FIG. 1 consists primarily of simple rotationally-symmetrical parts. It comprises an enclosure 1 consisting of two parts 1*a*, 1*b* which are screwed together to form a cavity 3 coaxial to a longitudinal axis 2.

Located within the cavity 3 is a first annular shoulder 3*a* against which rests the edge of a hard insulating disk 4, which is pressed against the shoulder by the screwed part 1*a* of the enclosure and held securely in the enclosure 1. Located in the center of the insulating disk 4 is a first contact in the form of a contact pin 7 extending perpendicularly to the coaxial cable 6 to be connected and to which pin the inner conductor 6*a* of the coaxial cable 6 is connected. The contact pin 7 has a wide foot 7*a*, at which point the pin is soldered (7*b*) to a coating of a solderable material (not shown in greater detail) located in the center of the insulating disk 4. This type of connection to the insulating disk 4 makes it particularly easy to ensure the necessary true alignment of the contact pin 7, in particular the tip of the pin, with the axis 2.

Adjoining the insulating disk 4 on the cable 6 side is a spacer 9, which forms a second coaxial annular shoulder at a distance from the insulating disk 4 toward the cable 6, on which shoulder lies the second contact to be connected to the coaxial cable 6. This contact comprises the contact spring device 10 shown on a larger scale in FIGS. 2 and 3.

Figure 3:
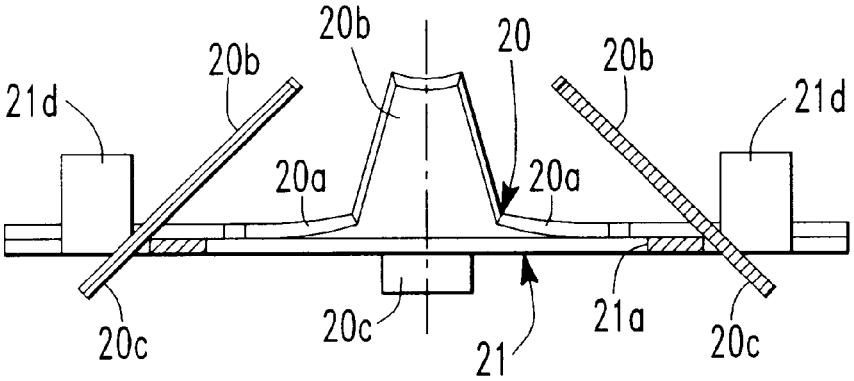
FIG. 2 is a larger scale plan view of a preferred embodiment of the spring device and FIG. 3 shows a section of the spring device as shown in FIG. 2 along the cut line III—III in FIG. 2.
Figure 2:
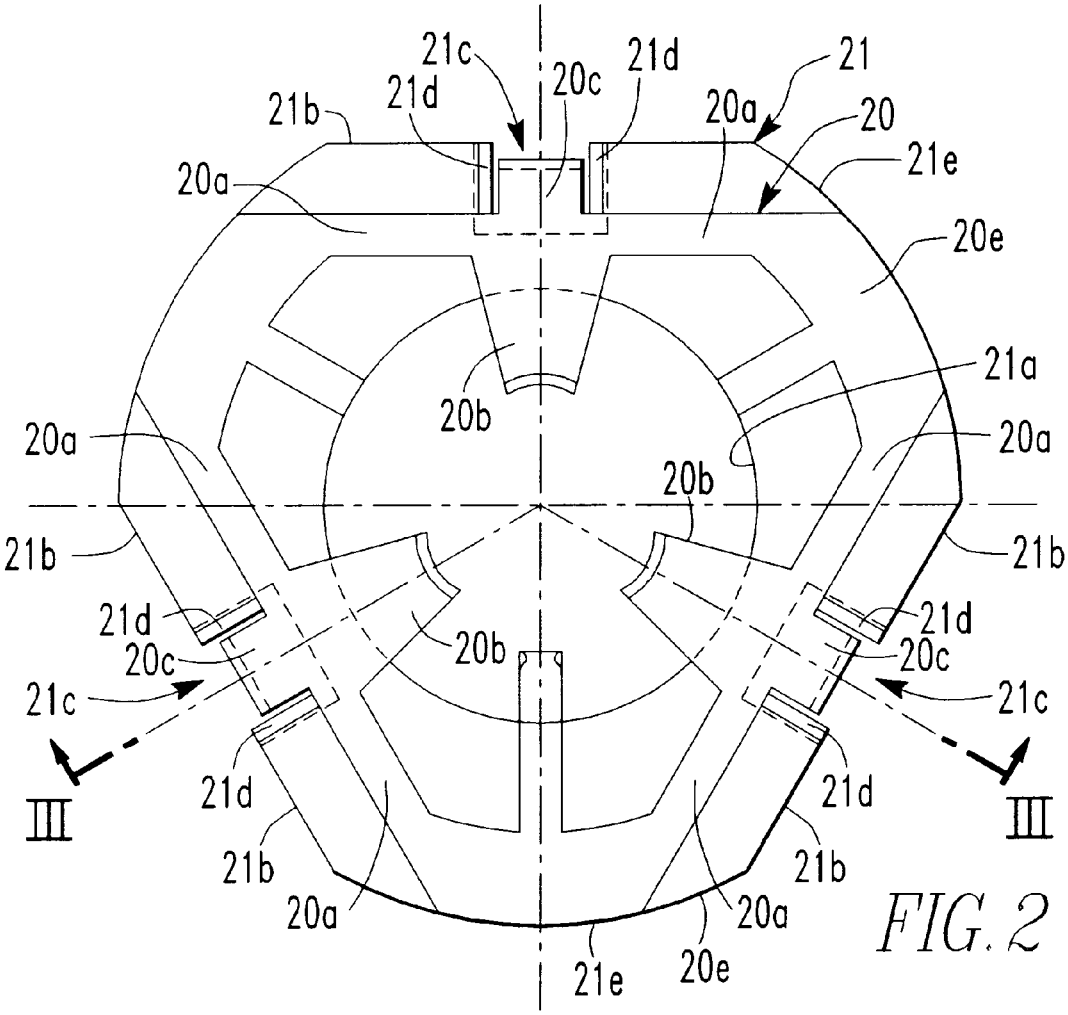

The contact spring device 10 shown in FIGS. 2 and 3 consists of two parts: a contact element 20 and a support element 21. These two parts are superimposed with, as shown in FIG. 1, the contact element 20 facing the coaxial cable 6 and the support element 21 located between the contact element 20 and the spacer 9 which forms the second annular shoulder 3*b*.

The contact element 20 is the part actually in contact with the coaxial cable 6 or the shielding thereof and is equipped with a circumferential containing segment 20*a* which essentially follows the line of an equilateral triangle, has rounded corners and is made of an elastic metal. Molded as a single piece onto the segments, which act as torsion springs, and extending toward the center away from the segments are contact studs 20*b*. These contact studs 20*b* extend outward in the direction of the straight parts to form tabs 20*c* and are bent outward at an angle from the plane of the containing segment 20*a* toward the coaxial cable 6. Their free ends in the form of blades reach the coaxial cable 6. As can best be seen in FIG. 2, the tabs 20*c* extend in alignment with the contact studs 20*b* to the other side of the containing segment 20*a*.

The support element 21 is essentially in the form of a triangle which, except for the center hole 21*a*, is holohedral with rounded corners 21*e* which overlap the rounded corners 20*e* of the containing segment 20*a* of the contact element 20. In the center of each straight edge 21*b* is a pocket-like recess 21*c* formed because two lobes 21*d* of the support element 21 material are bent upward on both sides of the recess toward the contact element 20 above. The contact element 20 engages via the tabs 20*c* in the pockets 21*c* of the support element 21 and is thus fixed in position relative to the latter. At the same time, the upward-bent lobes 21*d* support the center of the straight parts of the enclosing segment 20*a* of the contact element, which parts form the torsion springs, and prevent them from moving outward from the center of the triangle. Thus, these straight parts between the clamped, rounded corners 20*e* cannot deflect outward if an outwardly directed pressure is exerted on the blades of the contact studs 20*b* as occurs when the clamping nut 5 is tightened.

The contact spring device 10, with its circumferential segments 20*e*, 21*e* forming the rounded corners of the triangles is pressed against the second annular shoulder 3*b* by means of a metal thrust collar 12 braced against the screwed part 1*a* of the enclosure and thus held securely in the enclosure 1.

As is particularly clear from FIG. 2, the contact studs 20*b* of the contact spring device 10 are bent outward at identical angles from the plane of the circumferential segments 20*a* and toward the coaxial cable 6. They are separated from each other by a distance which is only slightly greater than the outside diameter of the coaxial cable 6.

A insert 11 coaxial to the central axis and which can be displaced in the axial direction of the enclosure 1 is inserted on that side of the contact pin 7 facing away from the spring device 10. This insert is made of an elastic rubber material and has a cylindrical, central bore 11*a* having the same dimensions as the coaxial cable 6 and a surface shell 11*b* in the form of a truncated cone which tapers away from the spring device 10. This insert 11 has a hard thrust face 11*c* on that end face facing the contact spring device 10. This surface presses against the free ends of the contact studs 20*b* of the contact element 20, bending these inward if the insert 11 is moved in the direction of the metal contact pin 7. The latter occurs by means of the clamping nut 5 which is screwed into the part 1*b* of the enclosure and presses against the elastic rubber insert 11 via a rigid insert 5*a*. The rigid insert 5*a* is cylindrical on the outside and is shaped on the inside in such a manner that it forms a surface 5*c* in the form of a truncated cone which matches the conical form of the insert 11.

FIG. 1 shows the parts of the device in the state immediately before the clamping nut 5 is tightened. The coaxial cable 6 is pushed through the bore 11*a* in the insert and onto the tip of the contact pin 7, which then makes contact with the inner conductor of the cleanly cut coaxial cable 6. If the clamping nut 5 is now tightened, the insert 11 appears to a person looking at FIG. 1 to be displaced to the right and, by means of the thrust face 11*c*, bends the contact studs 20*b* toward the contact pin 7 so that the contact studs 20*b* are also displaced inward toward the axis 2. The blades of the contact studs cut the outer insulation 6*b* of the coaxial cable 6 and come in contact with the cable shield below. At the same time, the coaxial cable 6 with its inner conductor 6*a* is also pushed somewhat farther onto the contact pin 7. In addition, the inner bore 11*a* of the rubber-like insert 11 is tapered and the cable 6 secured in two dimensions and sealed.

The thrust collar 12 has an inside surface in the form of a truncated cone which tapers from the insert 11 toward the contact pin 7. At the insert 11, the diameter of this tapered bore corresponds to the diameter of the end face of the insert 11 so that this can enter the bore but is compressed as it extends farther into the thrust collar 12, thus forming a seal between the coaxial cable 6 and the thrust collar 12, clamping the coaxial cable 6 and locking it into the device. An O-ring is inserted into the joint between the parts 1*a* and 1*b* of the enclosure, creating a seal. The cavity 3 in the enclosure 1 is thus hermetically sealed against the outside after connecting the coaxial cable 6 to the contact spring device 10 and the contact pin 7.

With the embodiment shown in FIG. 1, an electronic circuit in the form of a vibration sensor 13 is located in the part 1*b* of the enclosure on the other side of the insulating disk 4. This sensor is connected via a wire 14 to the contact pin 7 and also to the contact spring device 10 via the enclosure 1, and thus to the inner conductor and the cable shield of the coaxial cable 6.

If the clamping nut 5 is loosened again, the insert 11 is released and can be displaced outward. This unclamps the cable and the torsion spring effect of the straight parts 20*a* of the containing segment of the clamp element 20 push the spring tabs 20*b* out away from the coaxial cable. The cable can then be easily removed from the device. The device is then available for another connection.

Deviating from the above-mentioned configuration with built-in electronics, the device can also be configured so that it is symmetrical to a plane parallel to and, when looking at FIG. 1, to the right of the insulating disk. In this case, two coaxial cables can be easily connected; i.e. the device can also act as a cable coupling.

Another option is to run a two-conductor line of a type other than coaxial cable 6 from the enclosure 1 to devices located outside the enclosure 1; i.e. the device can also be used as an adapter.

With the device as shown in FIG. 1, the part 1*b* of the enclosure tapers to form a stem with external threads, making it possible to easily connect the device to a machine enclosure, which need only be equipped for this purpose with a threaded bore.

We claim:

1. Device for connecting a coaxial cable to first and second contacts which are secured in an enclosure, insulated from one another and can be connected to extension lead arrangements, the first contact includes a contact pin rigidly fastened in the enclosure and which extends centrally like a pin into a cavity of the enclosure to axially penetrate an inner conductor of the coaxial cable, and the second contact coaxially encircles the first contact in the cavity, whereby the enclosure is equipped with an insert having an inner bore to snugly seat the coaxial cable and whose center axis is in true alignment with the first contact, and which insert can, by means of a clamping nut which can be screwed with respect to the enclosure, be displaced in the longitudinal direction of the inner bore and clamped between the clamping nut and the enclosure so that the coaxial cable is fixed in relation to the enclosure, characterized by the fact that a) the second contact includes a contact spring device circumferentially clamped in a clamped position in the enclosure in an essentially rigid manner and having tabs with sharp free ends extending toward the contact pin, which tabs are bent outward at identical angles from a plane defined by the clamped position of the contact spring device toward the inner bore of the insert;

b) the insert is equipped on a side facing the contact pin and the contact spring device with a rigid thrust face which essentially extends to the inner bore of the insert and is intended for the exertion of pressure against the tabs of the contact spring device; and c) whereby the contact spring device, the contact pin and the insert are matched to one another and located in the enclosure with respect to one another in such a way that the contact pin axially penetrates the inner conductors of the coaxial cable and the tabs of the contact spring device cut an outer cable insulation and press into contact with a cable shield in the coaxial cable when the coaxial cable has been cleanly cut perpendicular to its longitudinal axis and is located in the inner bore of the insert, is pushed some distance onto the contact pin, and the insert is then pushed by means of the clamping nut over a defined distance toward the contact pin and is thus locked into place.

2. Device as claimed in claim 1, characterized by the fact that the insert is made of an elastic rubber material.

3. Device as claimed in claim 1, characterized by the fact that the contact pin extends perpendicularly from a hard insulating disk which rests against a first annular shoulder in the cavity and is clamped against the first annular shoulder.

4. Device as claimed in claim 3, characterized by the fact that the insulating disk has a central coating of solderable material and the contact pin is equipped with a foot soldered to the coating.

5. Device as claimed in claim 1, characterized by the fact that the spring device has a contact element equipped with an external containing segment which is generally symmetrical around a central point, extends along a regular polygon and can be at least indirectly clamped against walls of the cavity at corners of the polygon, and that contact studs extend from between the clamped corners inward toward the central point.

6. Device as claimed in claim 5, characterized by the fact that the contact spring device also has a support element which supports straight parts of the containing segment, preventing their displacement in an outward direction from the center point.

7. Device as claimed in claim 6, characterized by the fact that the contact element and the support element are equipped with positioning elements in the form of recesses whose relative positions are fixed, and lobes which engage in the recesses.

8. Device as claimed in claim 5, characterized by the fact that the contact pin extends perpendicularly from an insulating disk which rests against a first annular shoulder in the cavity and is clamped against the first annular shoulder and the clamped corners of the contact element are clamped against a second annular shoulder in the cavity, which shoulder is parallel to the first annular shoulder and some distance from it in the direction of the free end of the contact pin.

9. Device as claimed in claim 1, characterized by the fact that the insert conically tapers outward toward the enclosure and extends into a coaxial cavity in the clamping nut, the coaxial cavity having an inside surface forming a thrust face having a taper the same as the taper of the insert which rests against it.

10. Device as claimed in claim 9, characterized by the fact that the tapered inside surface of the coaxial cavity in the clamping nut is formed by the inside surface of another, outwardly cylindrical insert which is inserted snugly into the clamping nut.

11. Device as claimed in claim 1, characterized by the fact that the enclosure cavity expands conically in the direction of the insert from a diameter smaller than the diameter of the end of the insert to this end diameter.

12. Device of claim 8, characterized by the fact that the support element includes rounded corners clamped against the second annular shoulder in the cavity.

* * * * *